US006241484B1

(12) United States Patent
Hiltemann

(10) Patent No.: US 6,241,484 B1
(45) Date of Patent: Jun. 5, 2001

(54) RADIAL PISTON PUMP

(75) Inventor: Ulrich Hiltemann, Wermelskirchen (DE)

(73) Assignee: LuK Automobiltechnik GmbH & Co. KG (DE)

( * ) Notice: Subject to any disclaimer, the term of this patent is extended or adjusted under 35 U.S.C. 154(b) by 0 days.

(21) Appl. No.: 09/313,519

(22) Filed: May 17, 1999

(30) Foreign Application Priority Data

May 16, 1998 (DE) ..... 198 22 187

(51) Int. Cl.[7] ..... F04B 27/00
(52) U.S. Cl. ..... 417/273; 417/366
(58) Field of Search ..... 417/273, 366; 73/118.1

(56) References Cited

U.S. PATENT DOCUMENTS

| | | | | |
|---|---|---|---|---|
| 3,918,846 | * | 11/1975 | Winkler | 417/273 |
| 4,681,514 | * | 7/1987 | Griese et al. | 417/213 |
| 5,213,482 | * | 5/1993 | Reinartz et al. | 417/273 |
| 5,271,269 | * | 12/1993 | Rilling et al. | 73/118.1 |
| 5,354,183 | * | 10/1994 | Eisenbacher et al. | 417/273 |
| 5,472,319 | | 12/1995 | Rohlfing et al. . | |
| 5,979,297 | * | 11/1999 | Ricco | 92/129 |

FOREIGN PATENT DOCUMENTS

| | | | | |
|---|---|---|---|---|
| 2933316 | | 7/1980 | (DE) . | |
| 3706028 | | 9/1987 | (DE) . | |
| 3935116 | * | 5/1990 | (DE) | 417/273 |
| 2007496 | * | 4/1997 | (DE) | 417/273 |
| 1074371 | | 7/1967 | (GB) . | |
| 2002454 | | 2/1979 | (GB) . | |
| 2023718 | * | 1/1980 | (GB) | 417/273 |
| 2227057 | | 7/1990 | (GB) . | |
| 87/03047 | | 5/1987 | (WO) . | |

* cited by examiner

*Primary Examiner*—Cheryl J. Tyler
(74) *Attorney, Agent, or Firm*—Ostrolenk, Faber, Gerb & Soffen, LLP

(57) ABSTRACT

A radial piston pump includes cylinders oriented radially to an axis of rotation of an eccentric shaft and pistons arranged radially movably in the cylinders against the force of a spring member such that the pistons are pressed radially outwards by the rotational movement of an eccentric and radially inwards by the spring members. The pistons have at least one inlet opening connected to an inlet chamber of a pumping medium in the radially inner position of the pistons, and the pumping medium is pressed into a pressure area during the radially outward movement of the pistons. An eccentric shaft is mounted in sliding bearings arranged on both sides of the eccentric and the shaft is traction driven. A pressure connection between an annular duct and one of the sliding bearings advantageously provides a bearing gap between the sliding bearing and the eccentric shaft to constantly supply a close film of oil which has a damping effect upon the radial movements of the eccentric shaft. Thus, there is less noise due to the mechanical contact of the eccentric shaft with the sliding bearing.

27 Claims, 4 Drawing Sheets

RADIAL PISTON PUMP

BACKGROUND OF THE INVENTION

The invention relates to a radial piston pump, with cylinders oriented radially to an axis of rotation of an eccentric shaft, and with pistons arranged radially movably in the cylinders against the force of a spring. The pistons are pressed radially outwards by the rotational movement of an eccentric and are pressed radially inwards by the spring. The pistons have an inlet opening connected to an inlet chamber of a pumping medium when the pistons are in the radially inner positions. The pumping medium is pressed into a pressure area during the radially outward movement of the pistons. The eccentric shaft is mounted in sliding bearings arranged on both sides of the eccentric and is drivable by a traction means.

Radial piston pumps of this type are known. The alternating radial inward and outward movements of the pistons in the cylinders pump a medium, for example oil, is conveyed in a known manner. Radial piston pumps of this type are used for levelling systems in motor vehicles for example. In that case, the radial piston pump is driven by a belt drive which is driven by an internal-combustion engine of the motor vehicle. The belt engages on a drive wheel of the radial piston pump in order to rotate the eccentric shaft of the radial piston pump. The arrangement of the radial piston pump applies a belt force having a radial direction vector upon the eccentric shaft by the belt drive. The direction vector and the amount of the belt force are substantially constant.

In addition, the eccentric shaft is loaded by hydraulic forces which are introduced by the pistons of the radial piston pump and which likewise have a radial direction vector. A resulting hydraulic force of the radial piston pump, formed from partial hydraulic forces, is produced in accordance with the number of pistons of the radial piston pump. In this case the level and the direction vector of the resulting hydraulic force vary during use of the radial piston pump for its intended purpose in accordance with a rotational speed of the eccentric shaft. The constant belt force is overlaid by the variable hydraulic force, causing the eccentric shaft to be acted upon with a varying radial force. The resulting hydraulic force (also referred to as the "bearing force" below) has to be removed by the sliding bearings in which the eccentric shaft is mounted.

With large volumes in the radial piston pump and high hydraulic pressures, the resulting hydraulic forces can have a greater total than the belt force and, depending upon their operative direction, the hydraulic forces can cause a change in direction of the resulting force acting upon the eccentric shaft. In this way, the eccentric shaft can be pressed onto the sliding bearing against the belt force by the hydraulic forces. In this case, the actual resulting hydraulic force determines the direction vector of the resulting bearing force of the eccentric shaft and thus specifies a position of the eccentric shaft in the sliding bearing.

A drawback of this is that the change in position of the eccentric shaft in the sliding bearings can generate noise, a so-called knocking, as well as increased wear. In particular, if the radial piston pump is suction-throttled and is operated heavily regulated, phases can occur in which none of the pistons of the radial piston pump conveys the pumping medium, so that the eccentric shaft is oriented exclusively by the belt force as a result of the absence of hydraulic forces. At the beginning and the end of this phase, the resulting bearing force changes abruptly with respect to its direction vector, so that a reciprocating movement of the eccentric shaft occurs in the sliding bearings.

In addition, the hydraulic force acting upon the eccentric shaft does not change continuously, but changes abruptly, with respect to both the amount and the direction vector. Depending upon whether a piston of the radial piston pump begins or ceases to convey, the hydraulic force and thus the resulting bearing force produced by the superimposition with the belt force suddenly change.

It is known to lubricate the sliding bearings of the eccentric shaft in radial piston pumps with the pumping medium, for example oil. This oil is generally heavily foamed, particularly in the case of suction-regulated radial piston pumps, so that mixed friction of the eccentric shaft in the sliding bearings occurs as a result of air inclusions in the pumping medium. The mixed friction is not sufficient to damp the above-mentioned knocking of the eccentric shaft in the sliding bearings.

SUMMARY OF THE INVENTION

The object of the invention is to provide a radial piston pump of the above type which is simple in design and which prevents an eccentric shaft in a sliding bearing from knocking as a result of varying hydraulic forces which act upon the eccentric shaft.

This object is attained through a pressure connection present between the pressure area of the radial piston pump and at least one of the sliding bearings. It is advantageously possible for a bearing gap between the sliding bearing and the eccentric shaft to be constantly supplied with a closed film of oil which has a damping effect upon the radial movements of the eccentric shaft. This prevents the production of noise due to mechanical contact of the eccentric shaft with the sliding bearing. The radial piston pump as a whole operates more quietly. In particular, it is possible to counteract knocking by the superimposition of the hydraulic force acting upon the eccentric shaft and the belt force.

In a preferred embodiment of the invention, the pressure connection is formed by a duct which is formed in a housing of the radial piston pump and which opens with at least one outlet opening into the sliding bearing. This makes it possible to build up a volume flow of the pumping medium from the pressure area of the radial piston pump to the sliding bearing, and that volume flow performs the lubrication and damping of the sliding bearing.

In particular, the pumping medium is preferably conveyed into a radially central region of the sliding bearing. This makes a satisfactory distribution over the entire bearing surface of the sliding bearing possible, so that particularly good damping and lubrication can be achieved.

In a further preferred embodiment of the invention, the pressure connection opens in a range of ±90°, preferably ±50°, and in particular ±30°, with respect to a direction vector of the force of a traction means, in particular a belt traction force, acting upon the eccentric shaft. This advantageously makes it possible for the pressure build-up to first occur in particular in the region of the sliding bearing in which the eccentric shaft can be pressed against the bearing shell by the belt traction force, so that particularly good damping of the sliding bearing is provided in the direction of the belt traction force.

In addition, in a preferred embodiment of the invention, the pressure connection opens into a plurality of openings arranged preferably symmetrically over the periphery of the sliding bearing. This advantageously makes it possible for a uniform film of oil to be built up in the bearing gap between the eccentric shaft and the sliding bearing, enabling a high degree of damping of the sliding bearing in all radial directions, particularly in the case of radial piston pumps with high hydraulic forces which can be superimposed on the belt traction forces in an opposite manner.

Other objects and features of the invention are explained below in embodiments with reference to the accompanying drawings.

DESCRIPTION OF PREFERRED EMBODIMENTS

Figure 1:
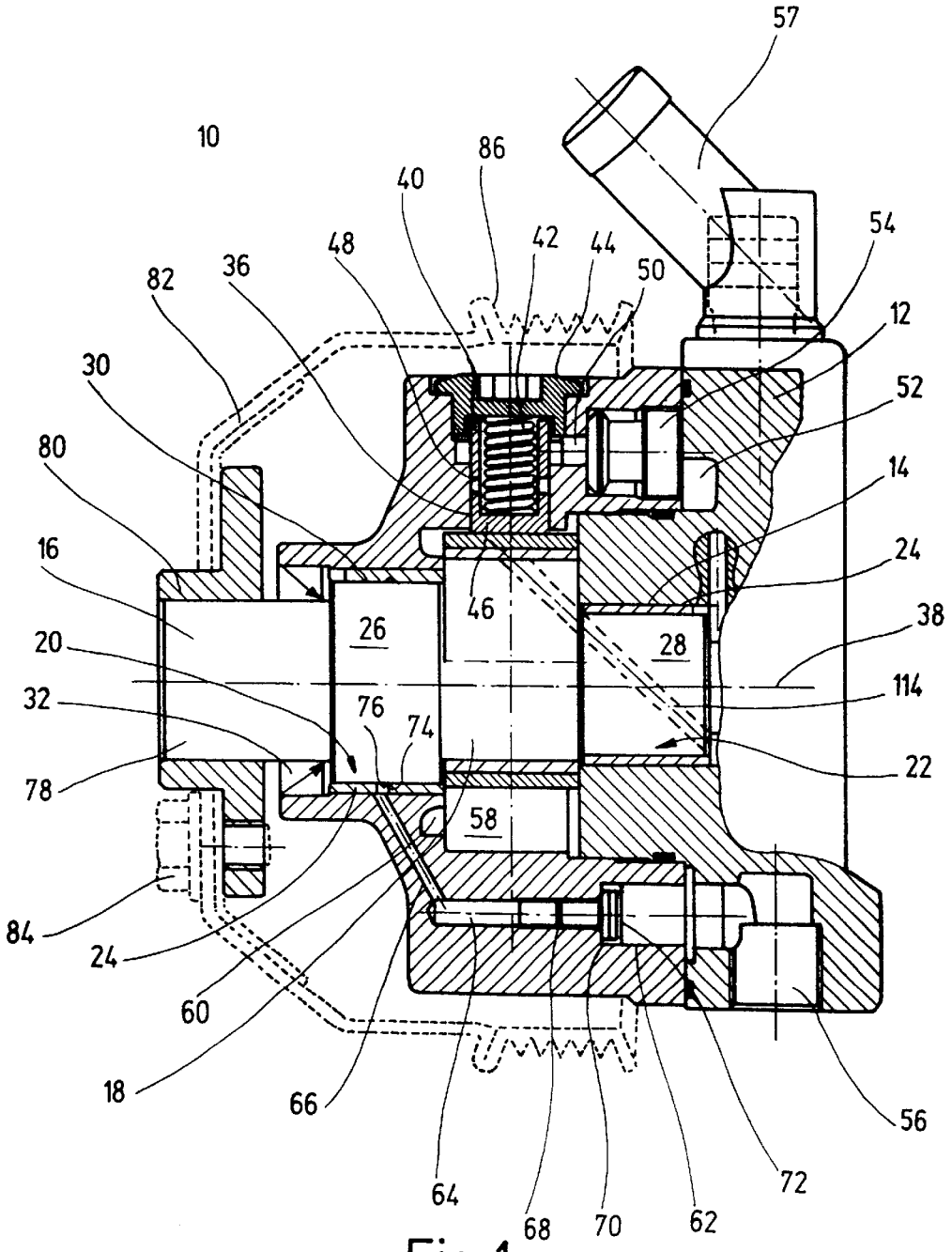
FIG. 1 is an elevational sectional view of a radial piston pump.

FIG. 1 is a sectional view of a radial piston pump 10. The radial piston pump 10 comprises a housing 12 in which a stepped bore 14 is formed. In order to form the stepped bore 14 the housing 12 may comprise a plurality of parts not explained individually below. The parts are connected to one another in a pressure-tight manner by suitable means. The stepped bore 14 receives an eccentric shaft 16 which carries an eccentric 18 located toward the axial center of the pump.

Sliding bearings 20 and 22 respectively, which mount the eccentric shaft 16, are arranged on axially opposite sides of the eccentric 18. Each sliding bearing comprises a respective bearing shell 24 which is inserted, for example pressed, into the stepped bore 14 of the housing 12. In the regions of the sliding bearings 20 and 22, the eccentric shaft 16 has portions 26 and 28 respectively of greater diameter, with external diameters adapted to the internal diameters of the respective bearing shells 24. The diameters are adapted to one another in such a way that a slight bearing gap 30 remains between the shaft portions 26, 28 and the bearing shells 24, respectively. Each bearing gap 30 is used to receive, in a manner to be explained below, a lubricant for the sliding bearings 20 and 22, respectively. In addition, the eccentric shaft 16 is guided in seals 32 and 34 respectively (FIG. 2) which provide a pressure-tight mounting for the eccentric shaft 16.

Cylinders 36, which are oriented radially to an axis of rotation 38 of the eccentric shaft 16, are inserted into the housing 12 in the axial region of the eccentric 18. The number of the cylinders 36 can vary with different radial piston pumps 10. In this way, it is possible for only one cylinder 36 or for a plurality of cylinders 36 to be provided, optionally arranged uniformly over the periphery of the eccentric 18. A piston 40, which is pressed against the eccentric 18 by the force of a spring 42, is guided inside each cylinder 36. The spring 42 is supported at one radially outward end on a plug 44 closing the cylinder 36 and at the other radially inward end on a base 46 of the piston 40. The piston 40 has the shape of a cup, with one opening oriented in the direction of the plug 44. At least one inlet opening 48 is provided in a peripheral wall of the piston 40. In the example illustrated, four inlet openings 48 are arranged symmetrically around the periphery of the piston 40.

A bore 50 leads from the cylinder 36 to an annular duct 52 in the housing 12. A valve 54 is arranged between the bore 50 and the annular duct 52. In the valve 54, a closure member closes a connection between the bore 50 and the annular duct 52 against the force of a spring. The annular duct 52 is connected to a pressure connection 56 of the radial piston pump 10.

In the region of the eccentric 18 the stepped bore 14 forms an inlet chamber 58 which is connected by at least one duct 60 to a suction connection 57 of the radial piston pump 10.

The annular duct 52 is connected to a stepped bore 62 which extends substantially parallel to the axis of rotation 38. A branch duct 66 leads from a portion 64 of the stepped bore 62 of smaller diameter to the sliding bearing 20. A throttle 68 or diaphragm is arranged in the portion 64. A step 70 of the stepped bore 62 receives a screen 72. A diameter of the throttle 68 preferably amounts to from 0.1 to 0.5 mm, in particular from 0.15 to 0.3 mm. A mesh width of the screen 72 is somewhat finer than the diameter of the throttle 68 and preferably amounts to from 0.1 to 0.4 mm.

The shell 24 of the sliding bearing 20 has a through opening 74 which at one end is connected to the branch duct 66 and at the other end opens into a coaxial annular groove 76 in the bearing shell 24, which is open in the direction of the portion 26 of the eccentric shaft 16.

An extension 78 of the eccentric shaft 16 carries a flange 80 to which a drive wheel 82 is fastened by at least one fastening means 84. The drive wheel 82 is pot-shaped and surrounds the housing 12 of the radial piston pump 10. The free end of the drive wheel 82 is provided with a receiving means 86 for a drive belt (not shown).

The bases 46 of pistons 40 are supported on a bearing race 110 (FIG. 2) which is constructed in the form of a steel ring for example. The bearing race 110 is supported on the eccentric 18. A plain bearing bush 112, which is pressed into the bearing race 110, is arranged between the eccentric 18 and the bearing race 110. The eccentric shaft 16 has a through opening 114 which at one end opens on the periphery of the eccentric 18 and at the other end is connected to a pressure area inside the radial piston pump 10. The pressure area is connected to the suction connection 57. In this way, a pressure which corresponds to the pressure at the suction connection 57, for example a tank pressure, is present in the through opening 114, which is formed, for example, as a bore extending at an angle to the axis of rotation 38. The through opening 114 preferably opens, as viewed in the axial extension of the eccentric 18, in the middle region thereof.

The radial piston pump 10 shown in FIG. 1 operates as follows:

The general operation of a radial piston pump 10 is known, so that within the scope of the present description there is no need to go into this in greater detail. The drive wheel 82 and thus the eccentric shaft 16 are set in rotation by the traction means. The eccentric 18 mounted in a rotationally fixed manner on the eccentric shaft 16 rotates jointly in accordance with the rotation of the eccentric shaft 16, so that in accordance with the eccentricity, the pistons 40 in abutting contact with the eccentric 18 have a radial lifting movement imparted to them. In this case, the pistons 40 are held at all times in abutting contact with the eccentric 18 by the spring 42, so that an alternating radial movement directed inwards and outwards takes place. Upon inward movement the inlet openings 48 overlap with the inlet chamber 58, so that the inner space of the piston 40 is filled with a medium to be conveyed, for example oil. This pumping medium is forced, through a decreasing volume of a space surrounded by the cylinder 36 in the piston 40, into the bore 50 by the subsequent movement of the piston radially outwards. In this way the valve 54 is opened, so that the pumping medium passes into the annular duct 52 and from there through the stepped bore 62 to the pressure connection 56 of the radial piston pump 10. When a plurality of pistons 40 are provided, they pump all the medium into the annular duct 52 in accordance with the principle described. The annular duct 52 is thus situated in a pressure area of the radial piston pump 10.

A pressure connection is built up with the sliding bearing 20 by way of the stepped bore 62, its portion 64 and the branch duct 66. In this case the throttle 68 arranged in the portion 64 limits a volume flow of the pumping medium which flows from the pressure area of the pump to the sliding bearing 20. Since the sliding bearing 20 is not sealed off in the direction of the inlet chamber 58 (see FIG. 2), circulation occurs between the pressure area and the suction area of the radial piston pump 10 by the sliding bearing 20. In this case an exact volume flow can be set in accordance with the setting of the throttle 68. The penetration into the sliding bearing 20 of impurities possibly taken up is prevented by the screen 72 positioned upstream of the throttle 68. These impurities are deposited on the screen 72. This prevents clogging of the throttle 68.

The bearing gap 30 is provided with an oil film (with oil as the pumping medium) by the adjusted volume flow by way of the sliding bearing 20. The oil film is distributed over the bearing gap 30 by the annular groove 76 which is preferably arranged coaxially with the axis of rotation 38 and is situated centrally with respect to an axial extension of the portion 26. In this case, the oil under pressure is forced into the annular groove 76 through the through opening 74, so that the oil is distributed over the annular groove 76. The oil under pressure present in the annular gap 30 causes the sliding bearing 20 to be lubricated in a reliable manner. Since the sliding bearing is lubricated satisfactorily with oil foamed to an insignificant extent, knocking movements of the eccentric shaft 16, which occur as a result of the superimposition of a belt traction force (to be explained hereinafter) and a hydraulic force acting upon the eccentric shaft 16, are damped.

In the embodiment illustrated, only the sliding bearing 20 is acted upon with an oil flow under pressure. In further embodiments, the sliding bearing 20 can likewise be acted upon, additionally or optionally exclusively, with pressure oil. For this purpose, suitably adapted connecting paths have to be provided from the pressure area of the radial piston pump 10 to the sliding bearing 20.

The through opening 114 in the eccentric shaft 16 improves lubrication between the eccentric 18 and the plain bearing bush 112. Because of a relatively high relative speed between the bearing race 110 and thus the plain bearing bush 112 and the eccentric 18, it is necessary to lubricate this area in order to prolong the service life and to damp noise. Since the medium to be conveyed (oil) is heavily foamed in the inlet chamber 58, this medium alone would not be sufficient to perform adequate lubrication. The oil in the eccentric space 58 is heavily foamed, since the oil flow drawn in is already throttled upstream of the inlet chamber 58. In this way, an under-pressure is present at the same time in the inlet chamber 58. Oil, which is insignificantly foamed and which is at the starting pressure (tank pressure), now passes through the through the opening 114 between the eccentric 18 and the plain bearing bush 112. As a result of a pressure drop between the inlet chamber 58 and the through opening 114, a constant oil flow is made available for lubricating the plain bearing bush 112.

Figure 2:
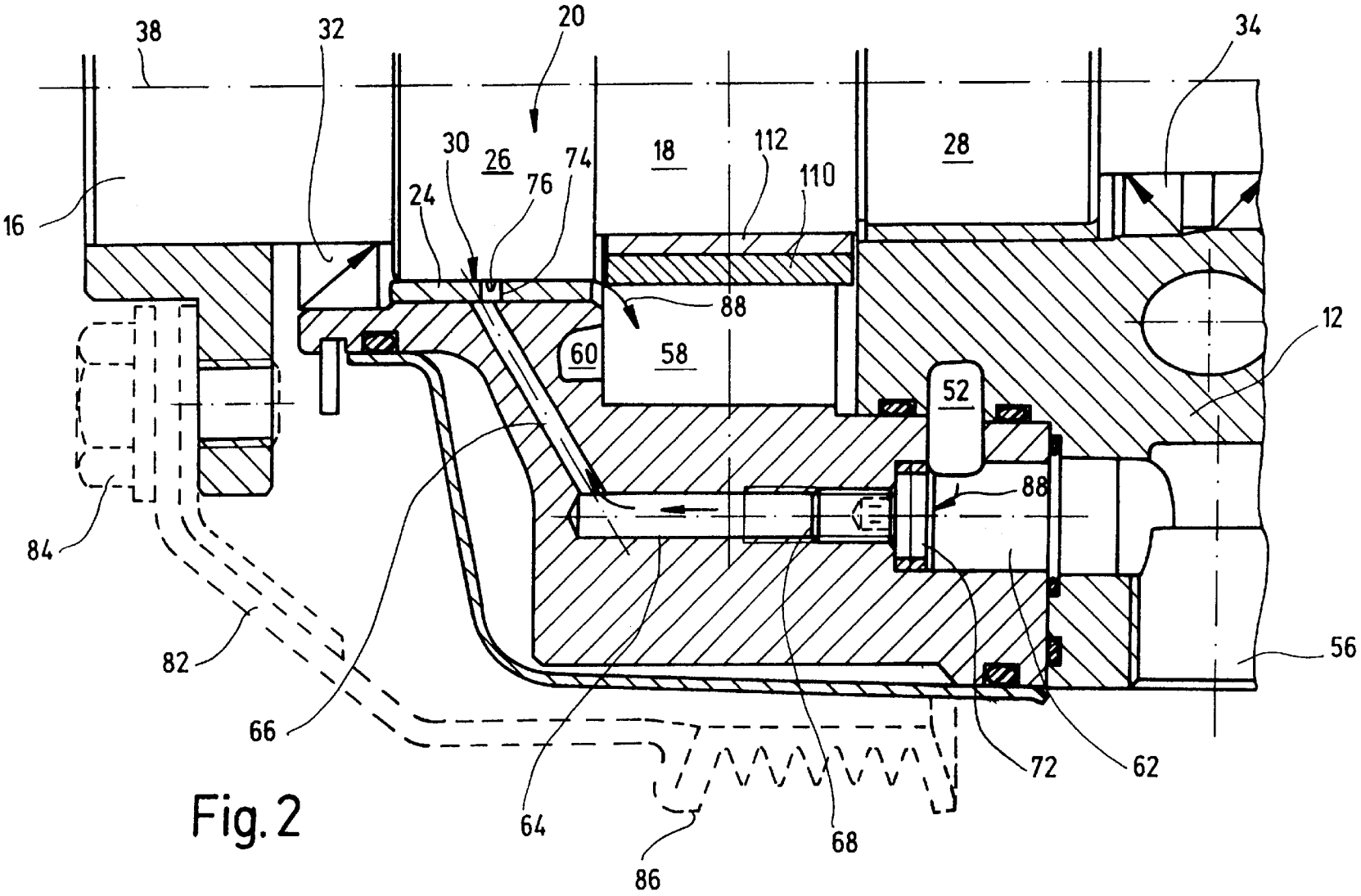
FIG. 2 is an enlarged sectional view of the radial piston pump according to FIG. 1, and FIGS. 3 to 6 are diagrammatic cross-sections through a sliding bearing of a radial piston pump in different embodiments.

FIG. 2 is a detailed view of an enlargement in part of the radial piston pump 10, the arrangement of the pressure connection between the pressure area of the radial piston pump 10 and the sliding bearing 20 being shown in particular. The same parts are provided with the same reference numerals as in FIG. 1 and are not explained further.

In particular, the pressure connection between the pressure area (annular duct 52) and the suction area (inlet chamber 58) of the radial piston pump 10 is labeled as reference numeral by an arrow 88 in FIG. 2. The pressure connection 88 is made to the inlet chamber 58 through the stepped bore 62, the portion 64 thereof, the branch duct 66, the through opening 74, the annular groove 76 and the bearing gap 30.

Radial sections through the portion 26 of the eccentric shaft 16 and thus the sliding bearing 20 are shown in each case in FIGS. 3 to 6.

Figure 3:
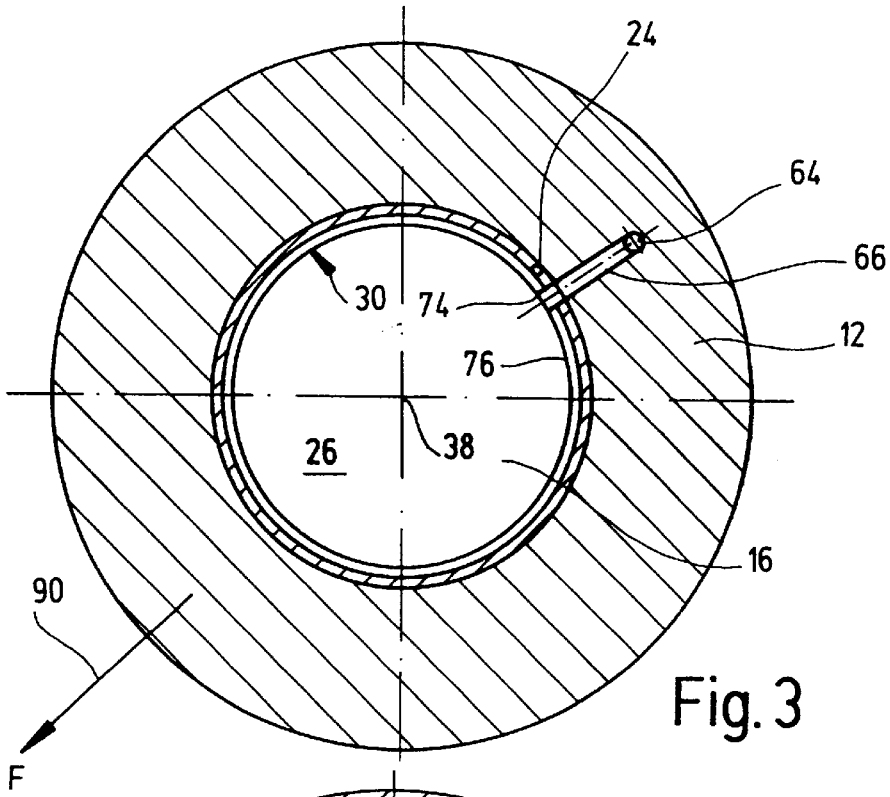

The through opening 74 opening into the annular groove 76 of the bearing shell 24 is shown in FIG. 3. The through opening 74 is connected to the branch duct 66 which in turn opens into the portion 64 of the stepped bore 62. The pressure oil is distributed over the entire periphery of the portion 26 of the eccentric shaft 16 by the annular groove 76. The bearing gap 30, the size of which is dependent upon a bearing clearance, is distributed over the annular groove 76. In this way, a thin film of an oil under pressure is built up as it were between the portion 26 and the bearing shell 24. Sufficient oil is thus present, which, in addition, is only moderately foamed, so that a hydrodynamic lubricating film can be built up in the sliding bearing.

In addition, an arrow 90, which corresponds to a direction vector of a belt traction force F, is indicated in FIG. 3. The belt traction force F acts upon the eccentric shaft 16 and has a direction vector which is dependent upon the action of a belt drive upon the drive wheel 82. The direction vector of the belt traction force F is dependent upon the installation point of the radial piston pump 10, for example in a motor vehicle with respect to an internal-combustion engine, which drives the belt. The direction vector and an amount of the belt traction force F are ideally constant. In FIG. 3, the through opening 74 opens into the annular groove 76 substantially opposite the operative direction of the belt traction force F. In further embodiments, the through opening 74 can open at any point in the annular groove 76 and thus with respect to the operative direction of the belt traction force F.

With a known fitted position of the radial piston pump 10, the through opening 74 can open into the bearing gap 30 in a defined position with respect to the operative direction of the belt traction force F by insertion of the pressure connection in a desired manner between the pressure area of the radial piston pump 10 and the sliding bearing 20.

Figure 4:
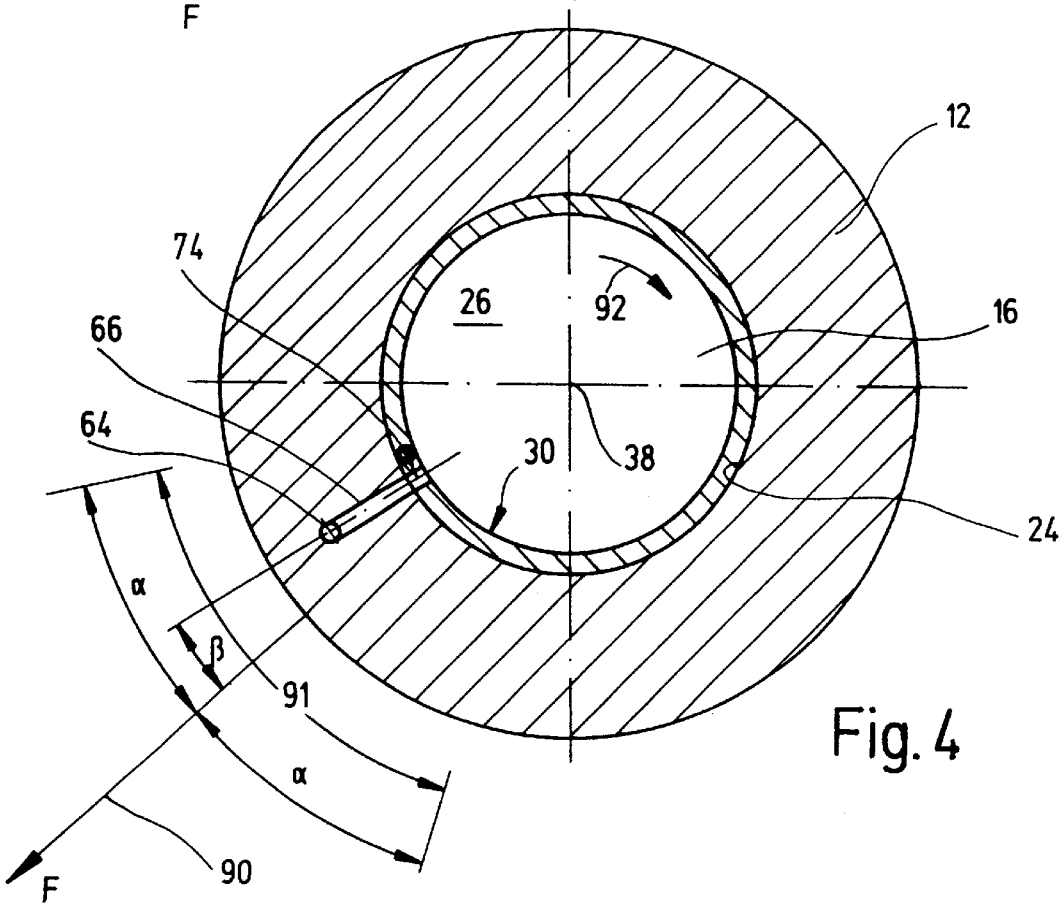

A preferred area 91, inside which the through opening 74 opens with respect to the operative direction of the belt traction force F, is indicated in FIG. 4. The area 91 encloses an angle $\alpha$ in and opposite a direction of rotation of the eccentric shaft 16 by the direction vector 90. In FIG. 4, the direction of rotation is assumed to be in the clockwise direction (arrow 92). The angle $\alpha$ amounts for example to 90°, preferably to 50° and in the embodiment illustrated in particular to 30°. In accordance with the illustration shown, inside the angle $\alpha$ the through opening 74 is arranged offset by an angle $\beta$ of about 10° in the direction of rotation 92 with respect to the operative direction 90 of the belt traction force F. This makes it possible for the pressure oil to flow into the bearing gap 30, into an area which—as viewed from the axis of rotation 38—is situated in the radial direction which is substantially in the operative direction of the belt traction force F. The pressure oil is distributed from this area 91 through the bearing gap 30 over the entire periphery of the sliding bearing 20. Since the cross-section for the volume flow of the pressure oil increases from the cross-section of the through opening 74 to the inlet chamber 58 (FIG. 2) in accordance with the design of the bearing gap 30, a slight build-up of pressure will occur at an increasing distance from the opening of the through opening 74. If the said opening is now situated in the said area 91 with respect to the belt traction force F, the greatest build-up of pressure will occur there, so that the belt traction force F can be compensated. In particular, if the belt traction force F is superimposed by an hydraulic force acting in the same operative direction as the belt traction force F, satisfactory damping of the clearance of the eccentric shaft 16 is achieved in the sliding bearing 20. The operative direction of the hydraulic force is not indicated in FIGS. 3 and 4, since it rotates, in terms of both the amount and the direction vector, in accordance with the rotational speed of the eccentric shaft 16, the volume flow of the radial piston pump 10 and the number of the pistons 40 following simultaneously and/or in succession. The hydraulic force is superimposed upon the belt traction force F so as to form a resulting bearing force by which the portion 26 of the eccentric shaft 16 is pressed against the bearing shell 24. This resulting bearing force likewise has a rotating direction vector with a different amount which is dependent upon the momentary direction vector of the hydraulic force from the constant direction vector of the belt traction force F. If viewed graphically, it produces an elliptical curve of the resulting bearing force about the axis of rotation 38. As a result of the pressure oil introduced into the bearing gap 30, a damping of the radial movement of the portion 26 of the eccentric shaft 16 in the sliding bearing 20 is achieved independently of the amount and the direction vector of the resulting bearing force.

In the embodiment illustrated in FIG. 4, the arrangement of the annular groove 76 is omitted. The through opening 74 thus opens directly as a lubrication bore relief into the bearing gap 30. In accordance with a further embodiment, an annular groove corresponding to the through opening 74 can be arranged in the portion 26 of the eccentric shaft 16.

Figure 5:
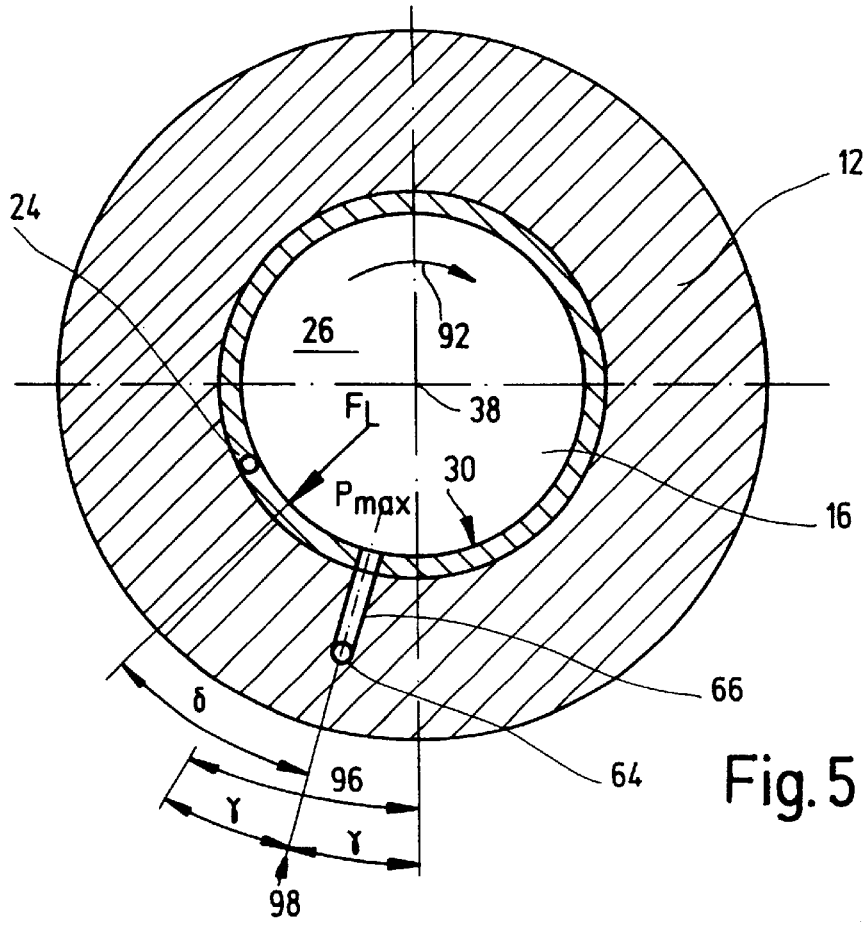

The arrangement of the through opening 74 with respect to a maximum pressure point $P_{max}$ of the eccentric shaft 16 is shown in FIG. 5. In this case the pressure point $P_{max}$ corresponds to the point at which the greatest resulting bearing force $F_L$ can occur, which is derived from the superimposition of the belt traction force F and the hydraulic force. The pressure point $P_{max}$ can be determined from the fitted position of the radial piston pump 10 and the theoretically calculable maximum hydraulic forces. In this case the through opening 74 opens into an area 96 which is situated either in or opposite the direction of rotation 92 by an angle $\gamma$ about a point 98 (radial), the point 98 being situated in front of the pressure point $P_{max}$ by an angle $\delta$ opposite the direction of rotation 92. As a result, the pressure oil in the bearing gap 30 flows into the bearing gap 30 in the angular range $\pm\gamma$ with respect to the angle $\delta$ and is taken up by the rotational movement of the eccentric shaft 16 into the area of the maximum pressure point $P_{max}$. In this way, a constant high pressure, which results in a reliable damping of the movement of the eccentric shaft 16 in the sliding bearing 20, can build up in the bearing gap 30 in the area of the maximum pressure point $P_{max}$. The angle $\delta$ preferably amounts to 30° and the angle $\gamma$ preferably amounts to 15°.

Figure 6:
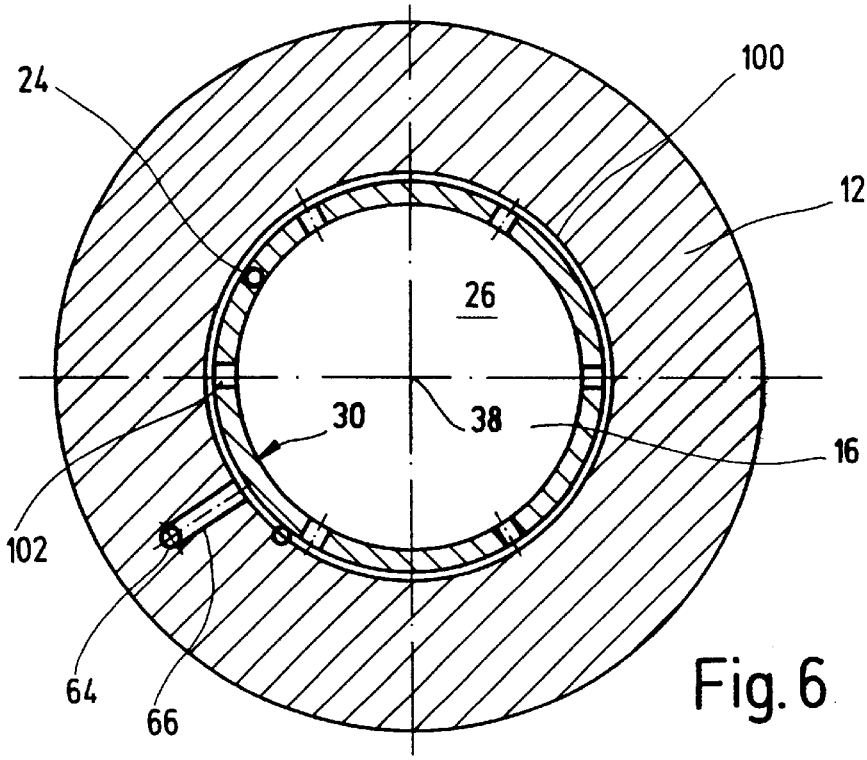

FIG. 6 shows a further variant of embodiment, in which an annular groove 100 is formed in the housing 12. The branch duct 66 opens into the annular groove 100. The annular groove extends coaxially around the bearing shell 24. In the region of the annular groove 100 the bearing shell 24 is provided with at least one through opening 102, six through openings 102 in the example illustrated, by way of which the pressure oil arrives in the bearing gap 30. In this case the through openings 102 are arranged symmetrically over the periphery of the bearing shell 24. In accordance with further embodiments the arrangement of the through openings 102 can be made in such a way that they are arranged at smaller intervals in the area of the maximum pressure point $P_{max}$ and/or the area of the operative direction of the belt traction force F.

A combination of the different variants of embodiment illustrated in FIGS. 3 to 6 is possible. In this way, in particular in accordance with a further embodiment, it can be provided that the bearing shell 24 comprises two partial bearing shells which are arranged at a slight axial distance from each other in order to form the annular groove 76.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A radial piston pump comprising:

a pump housing;

a shaft extending through the housing, the shaft having a rotation axis and an eccentric on the shaft in the housing; a traction drive for driving the shaft to rotate with respect to the housing;

at least one cylinder oriented radially to the axis of the rotation of the shaft;

for each cylinder, a piston disposed in the cylinder;

a spring acting on the piston pressing the piston radially inwardly against the eccentric on the shaft, and the eccentric being shaped such that rotation of the shaft moves the piston radially outwardly;

an inlet opening into the piston;

a pumping medium receiving chamber in the piston for receiving pumping medium into the pumping medium receiving chamber in the piston through the inlet opening into the piston;

an inlet chamber for pumping medium in the housing, the inlet opening into the piston being positioned so that when the piston is in the radially inward position, the inlet opening communicates with the inlet chamber thereby to pass the pumping medium through the inlet opening into the pumping medium receiving chamber;

a pressure area in the housing communicating with the interior of the piston so that as the piston is moved radially outwardly, the pumping medium is pressed by the piston into the pressure area;

a respective sliding bearing in the housing at each axial side of the eccentric and located between the shaft and the housing; each of the sliding bearings including a bearing shell around the shaft; at least one through opening passing through one of the bearing shells;

a bearing gap between each bearing shell and the shaft; a coaxial, annular groove inside the bearing shell and opening toward the bearing gap and the shaft, and the through opening communicating into the annular groove; and a pressure connection between the pressure area to which pumping medium is pumped and the through opening through the one bearing shell for delivering pumping medium from the pressure area to the bearing gap between the one sliding bearing shell and the shaft.

2. The radial piston pump of claim 1, wherein the pressure connection comprises a fluid connection in the housing and at least one outlet opening from the fluid connection to the at least one sliding bearing.

3. The radial piston pump of claim 1, further comprising a bearing race on a bearing bush at the eccentric and the pistons engaging the bearing race at the eccentric.

4. The radial piston pump of claim 3, further comprising at least one through opening in the eccentric shaft and a suction connection to the through opening, wherein the through opening opens onto the outer periphery of the eccentric.

5. The radial piston pump of claim 1, further comprising a diaphragm in the fluid connection.

6. The radial piston pump of claim 1, further comprising a flow throttle in the fluid connection.

7. The radial piston pump of claim 6, wherein the throttle has a diameter in the range of 0.1 to 0.5 mm.

8. The radial piston pump of claim 7, wherein the throttle diameter is in the range of 0.15 to 0.3 mm.

9. The radial piston pump of claim 6, further comprising a screen in the fluid connection preceding the throttle in the flow direction toward the bearing shell.

10. The radial piston pump of claim 9, wherein the screen has a mesh width in the range of 0.1 to 0.4 mm.

11. The radial piston pump of claim 1, wherein the sliding bearing has an axial extension; and each fluid connection opens centrally with respect to the axis of rotation of the shaft and the sliding bearing has an axial extension in which the fluid connection opens.

12. The radial piston pump of claim 1, wherein the fluid connection opens into an area of the housing, and the area extends over an angle $\alpha$ both in and opposite the direction of rotation of the shaft and wherein bisection of the angle coincides with a direction vector of the force of the traction device acting on the shaft.

13. The radial piston pump of claim 12, wherein the angle $\alpha$ is 90°.

14. The radial piston pump of claim 12, wherein the angle $\alpha$ is 50°.

15. The radial piston pump of claim 12, wherein the angle $\alpha$ is 30°.

16. The radial piston pump of claim 12, wherein the fluid connection opens into the housing in the direction of rotation of the shaft at an angle $\beta$ from the direction vector.

17. The radial piston pump of claim 16, wherein the angle $\beta$ is in the range of 5 to 15°.

18. The radial piston pump of claim 16, wherein the angle $\beta$ is 10°.

19. The radial piston pump of claim 12, wherein there is an annular groove formed in the housing around the bearing shell and the fluid connection opens into the annular groove;

a plurality of through openings through the bearing shell and into the annular groove, wherein the through openings in the region of the direction vector have a smaller spacing interval around the periphery of the bearing shell than in the remaining peripheral area.

20. The radial piston pump of claim 1, wherein the fluid connection opens into the housing in the direction of rotation of the shaft at an angle $\beta$ from a direction vector of the force of the traction device acting on the shaft.

21. The radial piston pump of claim 1, wherein the fluid connection opens into an area that forms an angle $\gamma$ in or an angle $\gamma$ opposite the direction of shaft rotation and on opposite sides of a radius of the shaft, wherein the radius on which the fluid connection is disposed is upstream of a pressure point $P_{max}$ by an angle $\delta$ and wherein the greatest bearing force $F_L$ resulting from superimposition of the force applied by the traction device and hydraulic force occurs.

22. The radial piston pump of claim 21, wherein the angle $\gamma$ is 15°.

23. The radial piston pump of claim 21, wherein the angle $\gamma$ is 30°.

24. The radial piston pump of claim 21, wherein there is an annular groove formed in the housing around the bearing shell and the fluid connection opens into the annular groove;

a plurality of through openings through the bearing shell and into the annular groove, wherein the through openings in the region of the areas forming an angle $\gamma$ have a small spacing interval around the periphery of the bearing shell than in the remaining areas forming the angle $\gamma$.

25. The radial piston pump of claim 1, further comprising an annular groove formed in the housing around the bearing shell and the fluid connection opens into the annular groove.

26. The radial piston pump of claim 25, further comprising six through openings through the bearing shell and arranged symmetrically around the bearing shell and each extending into the annular groove.

27. The radial piston pump of claim 1, wherein the bearing shell is comprised of two partial bearing shells axially spaced from each other and forming the bearing shell and being shaped to together cooperate to define the annular groove.

* * * * *